United States Patent [19]

Odle et al.

[11] 4,037,341

[45] July 26, 1977

[54] LUMINAIRE FOR LIGHTING A SIGN AND METHOD

[75] Inventors: Herbert Arnold Odle; Daryl Dean Sullivan; Kurt Franck, all of Newark, Ohio

[73] Assignee: Johns-Manville Corporation, Denver, Colo.

[21] Appl. No.: 387,879

[22] Filed: Aug. 13, 1973

[51] Int. Cl.[2] ..... G09F 13/00

[52] U.S. Cl. ..... 40/130 B; 240/41.36

[58] Field of Search ..... 40/130 B, 130 R, 125 K, 40/152.2; 240/41.35 R, 41.35 E, 41.35 F, 41.36, 41.37, 2 R, 2 AD, 93, 103 R

[56] References Cited

U.S. PATENT DOCUMENTS

| | | | |
|---|---|---|---|
| 1,788,843 | 1/1931 | Overholtz | 40/130 R |
| 2,058,548 | 10/1936 | Arras | 240/41.36 |
| 2,147,959 | 2/1939 | Arbuckle | 40/130 B |
| 2,220,262 | 11/1940 | Miller | 40/152.2 |
| 3,090,280 | 5/1963 | Winter, Jr. | 40/125 K |
| 3,160,350 | 12/1964 | Rex et al. | 240/93 X |
| 3,257,553 | 6/1966 | Tolbert | 240/41.35 R X |
| 3,524,051 | 8/1970 | Baldwin et al. | 240/93 X |
| 3,588,493 | 6/1971 | Nordquist | 240/41.37 |

*Primary Examiner*—Robert W. Michell
*Assistant Examiner*—V. Millin
*Attorney, Agent, or Firm*—Robert M. Krone; Joseph J. Kelly; Stephen C. Shear

[57] ABSTRACT

A sign lighting arrangement including a luminaire located in a predetermined position in front of a rectangular sign is disclosed herein. The luminaire includes a light source supported by an opaque housing, the uppermost edges of which lie in a common plane with the light source and the bottom edge of the sign. In this manner, direct light from the light source is prevented from passing under the sign (positive bottom edge cut-off). The luminaire also includes a reflector having lateral edge portions located in a fixed position relative to the luminaire's light source and the sign. The reflector and particularly these lateral edge portions are specifically contoured so that the lateralmost vertical edges of the reflected light substantially coincide with the side edges of the sign. Thus no reflected light passes beyond these side edges (positive side edge cut-off). A refractor is provided one purpose of which is to aid in achieving positive side edge cut-off.

14 Claims, 12 Drawing Figures

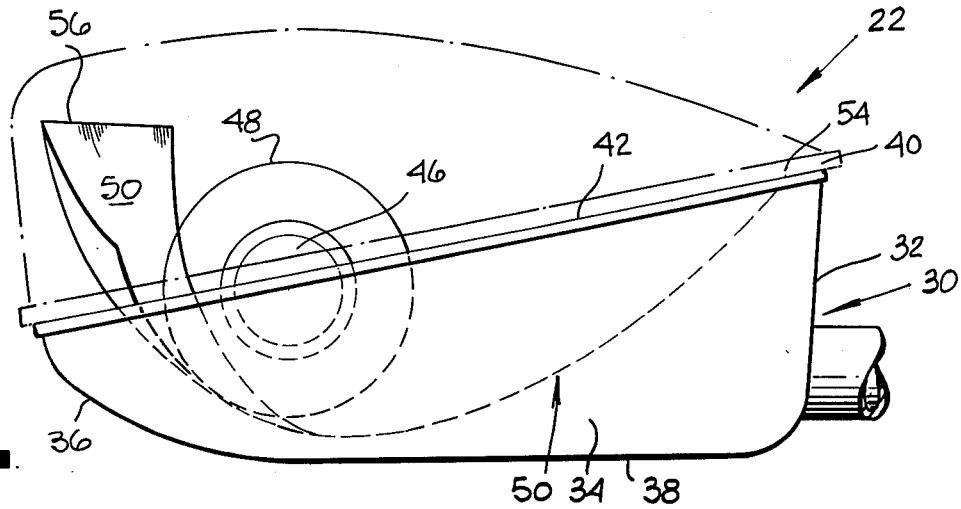
Fig. 3.
Fig. 4.
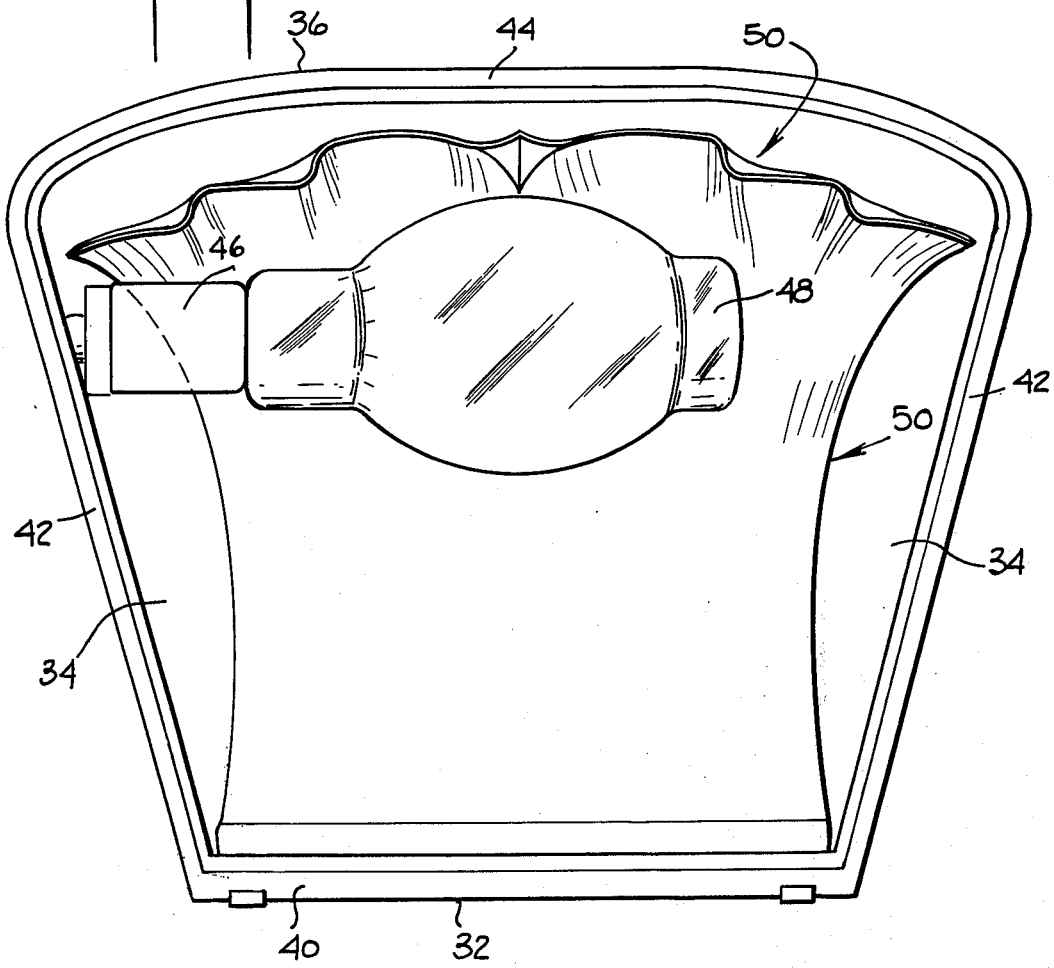

Fig. 5.
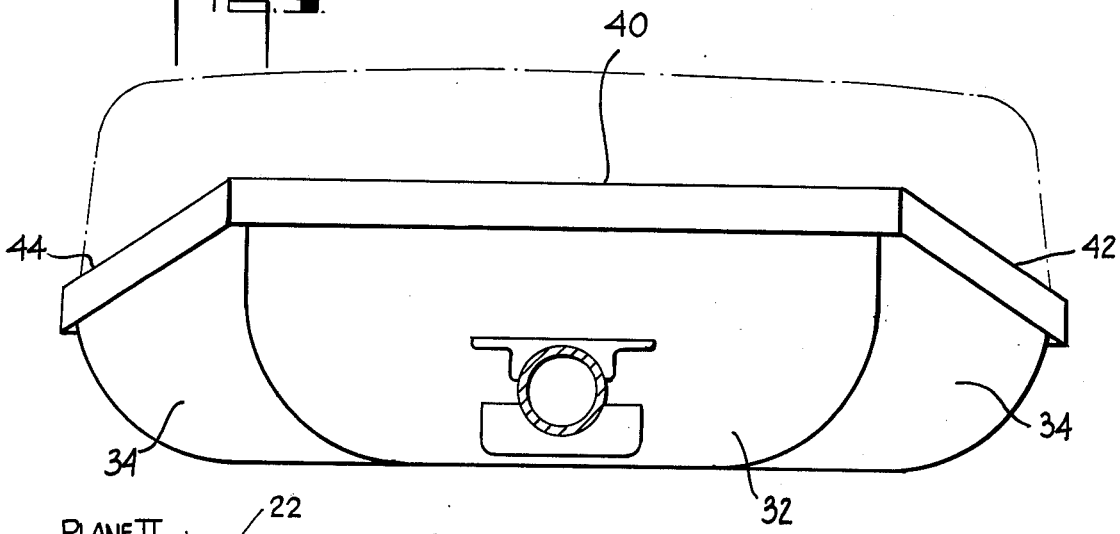
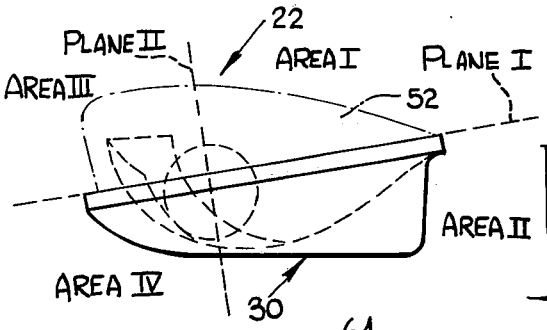
Fig. 6.
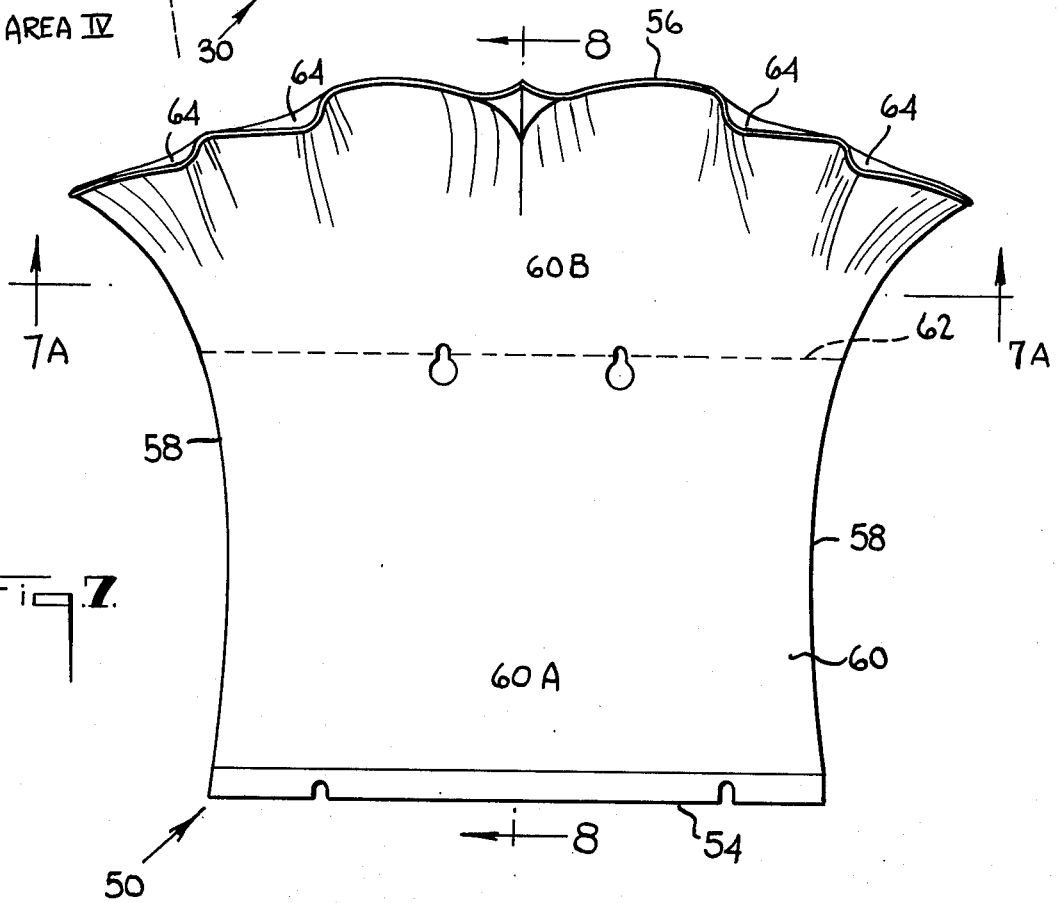
Fig. 7.

Fig. 7A.
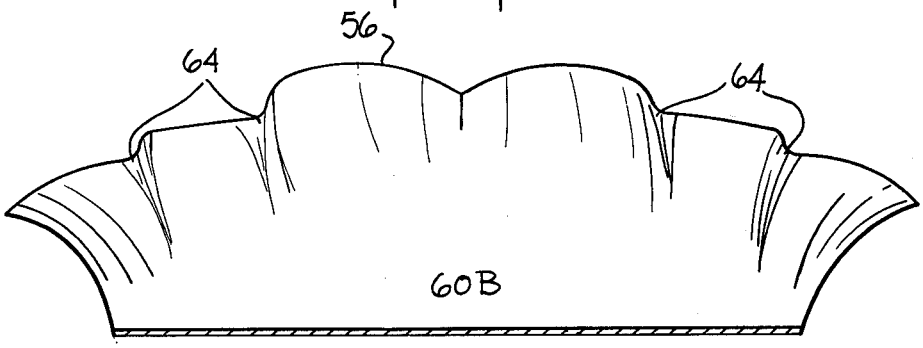
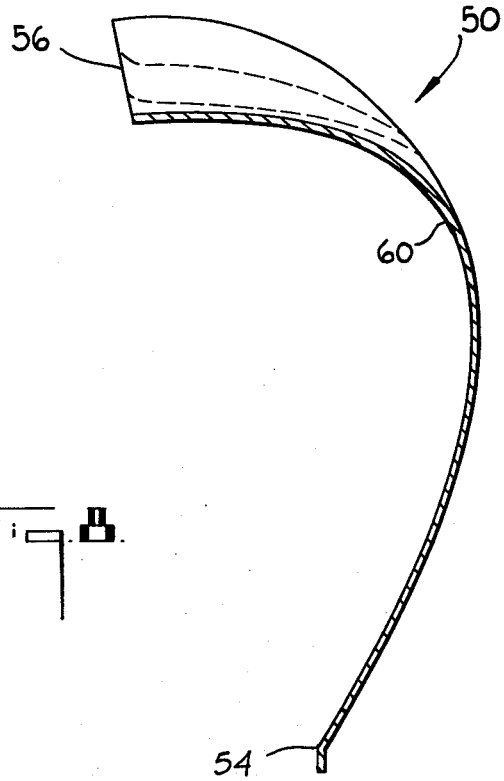
Fig. 8.

Fig. 9.
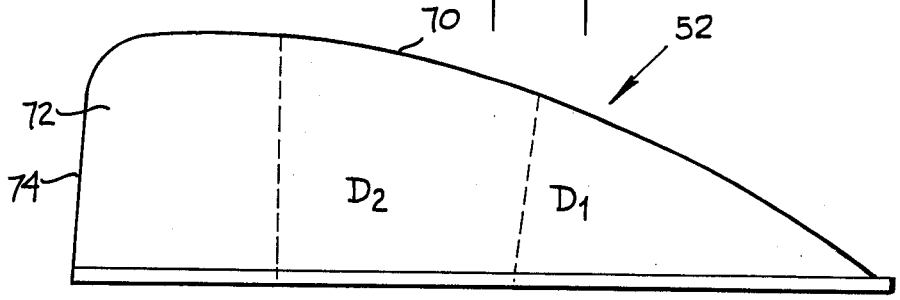
Fig. 10.
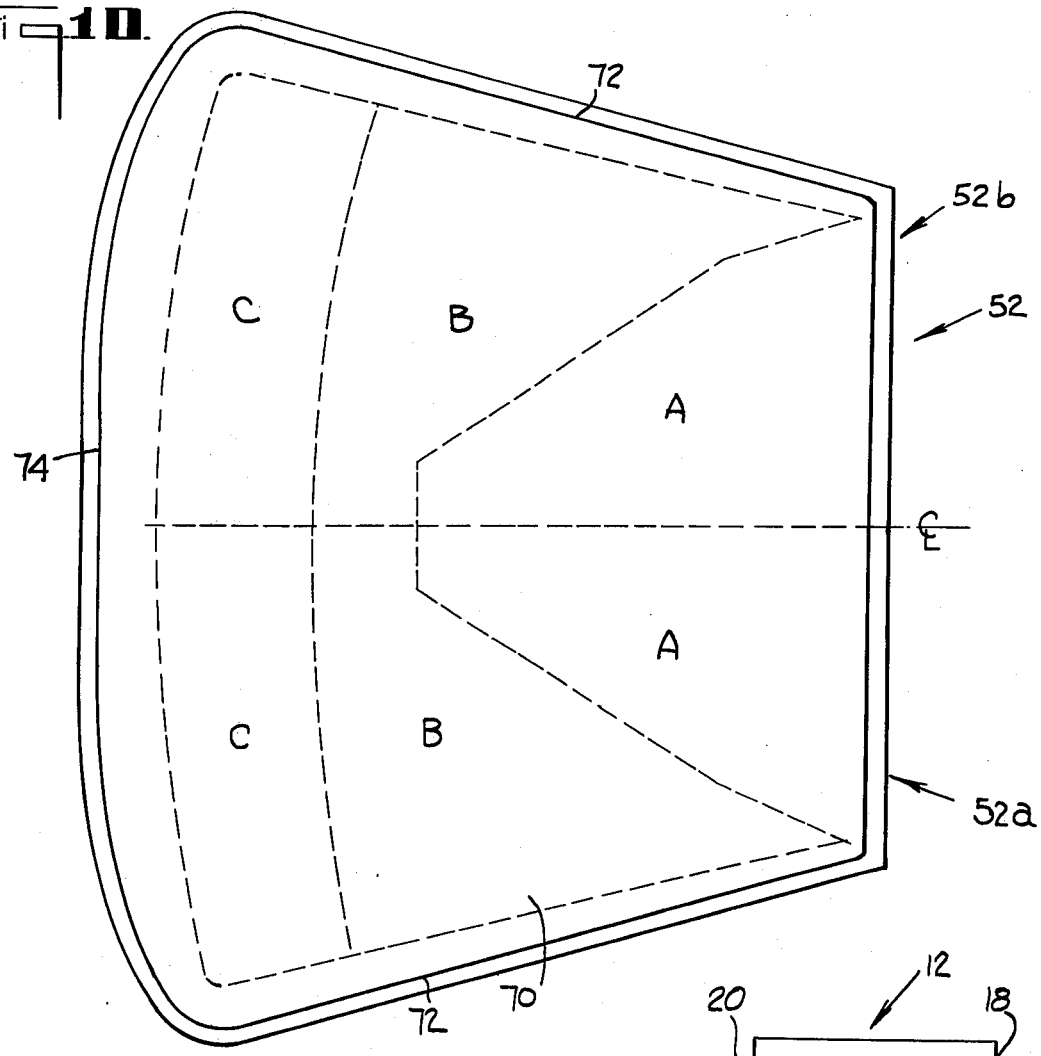
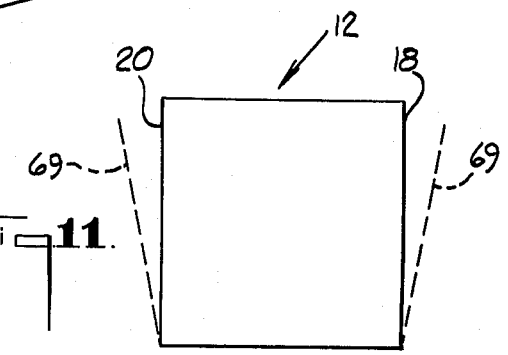
Fig. 11.

LUMINAIRE FOR LIGHTING A SIGN AND METHOD

BACKGROUND OF THE INVENTION

1. Field of the Invention

The present invention is directed generally to the luminaire art and more particularly to a sign lighting method and arrangement and a luminaire utilized in this method and arrangement.

2. Description of Prior Art

There are a great number of sign lighting arrangements in operation today, especially along our highways where signs setting forth information to the traveler require a high degree of visibility. Typically, luminaires utilized in lighting up these signs are positioned in front of the sign near the sign's top edge or bottom edge and centrally between its side edges. This type of arrangement creates two problems to which the present invention is directed and overcomes in a unique manner, as will be seen hereinafter.

One such problem results from an attempt by previous conventional arrangements to illuminate the entire bottom edge (or top edge) of the sign. More specifically, to illuminate, for example, the sign's entire bottom edge (when the luminaire is positioned near the bottom edge) it has heretofore been necessary to allow some light to pass under the sign. This, of course, results in an inefficient utilization of light, but also can create a situation of possibly blinding drivers coming towards the back of the sign. An obvious but unsatisfactory solution to this problem has been to forego illuminating the entire bottom edge, or the entire top edge of the sign when the luminaire is positioned near the top of the sign.

A second problem which is created by locating the luminaire centrally in front of and near either the bottom or top edge of the sign resides in the inability of conventional luminaires to efficiently illuminate the entire side edge portions of the sign. More specifically, with the sign and a conventional luminaire so located, the luminaire will effectively light up only portions of the sign's lateral edges, or alternatively to light the entire edges, much of the light will pass beyond the sides of the sign. Neither of these alternatives is completely satisfactory for the reasons stated above but results from the geometry in locating the sign and luminaire in the manner set forth. Conventional luminaires, as designed, do not take into account this geometry. In fact, the prior art has not recognized its significance but rather has been satisfied with the above-stated alternatives.

BRIEF SUMMARY OF THE INVENTION

In view of the foregoing, an object of the present invention is to provide a method and arrangement for directing light onto a rectangular sign and particularly for directing light along the entire bottom edge of the sign such that none of the light is directed under the bottom edge (positive bottom edge cut-off).

Another object of the present invention is to provide a method and arrangement for directing light onto a rectangular sign and particularly along the entire side edge portions of the sign such that practically none of the light passes beyond these side edge portions (positive side edge cut-off).

Still another object of the present invention is to provide a luminaire which is capable of carrying out the positive cut-off features set forth in the above-stated objects.

In accordance with one feature of the present invention, a luminaire is provided with a light source and a luminaire support including a light opaque front section and light opaque side sections extending from opposite ends of the front section. Both the side sections and the front section include flat top edges which lie in a common plane with the light source.

In a preferred arrangement of the present invention, the luminaire is positioned in front of a rectangular sign to be illuminated, centrally between the lateral edges of the sign and in proximity to the bottom edge thereof. In addition, the luminaire is aligned with the sign such that the sign's bottom edge lies in the aforestated common plane with the light source and top edges of the support sections. In this manner, light can be directed from the source onto the entire bottom edge of the sign while the opaque support sections prevent direct light from the source from passing under the sign's bottom edge. This may be referred to as a positive bottom edge cut-off.

In accordance with another feature of the present invention, the luminaire includes a reflector for intercepting light from the light source and redirecting this intercepted light onto the rectangular sign. The reflector includes lateral edge portions which are specifically contoured in their entirety to intercept light from the light source and redirect this intercepted light onto the entire side edge portions of the sign in straight lines. More specifically, the lateralmost vertical edges of this reflected light coincide with the side edges of the sign such that none of the light reflected by the contoured edge portions passes beyond the side edges of the sign. This may be referred to as positive side edge cut-off. In this regard, a specially designed refractor is provided to aid in obtaining this positive cut-off.

BRIEF DESCRIPTION OF THE DRAWINGS

FIG. 3 is an enlarged side elevational view of a luminaire constructed in accordance with the present invention and utilized with the arrangement illustrated in FIGS. 1 and 2.

FIG. 4 is a top plan view of the luminaire illustrated in FIG. 3.

FIG. 5 is a front elevational view of the luminaire illustrated in FIG. 3.

FIG. 6 schematically illustrates operationally the arrangement of FIGS. 1 and 2 utilizing the luminaire of FIGS. 3–5.

FIG. 7 is a plan view of a reflector constructed in accordance with the present invention and utilized in the luminaire of FIGS. 3–5.

FIG. 7A is a sectional view taken along line 7A—7A in FIG. 7.

FIG. 8 is a cross-sectional view of the reflector taken generally along line 8—8 in FIG. 7.

FIG. 9 is a side elevational view of a refractor in accordance with the present invention.

FIG. 10 is a plan view of the refractor of FIG. 9.

FIG. 11 is a plan view of a rectangular sign comprising part of the arrangement of FIG. 1.

DETAILED DESCRIPTION AND PREFERRED EMBODIMENTS

Figure 1:
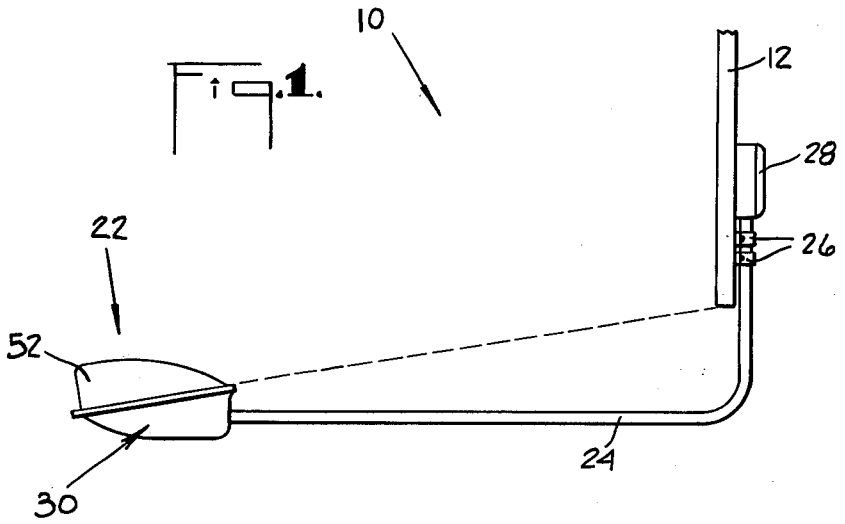
FIG. 1 is a side elevational view of a sign lighting arrangement in accordance with the present invention.
Figure 2:
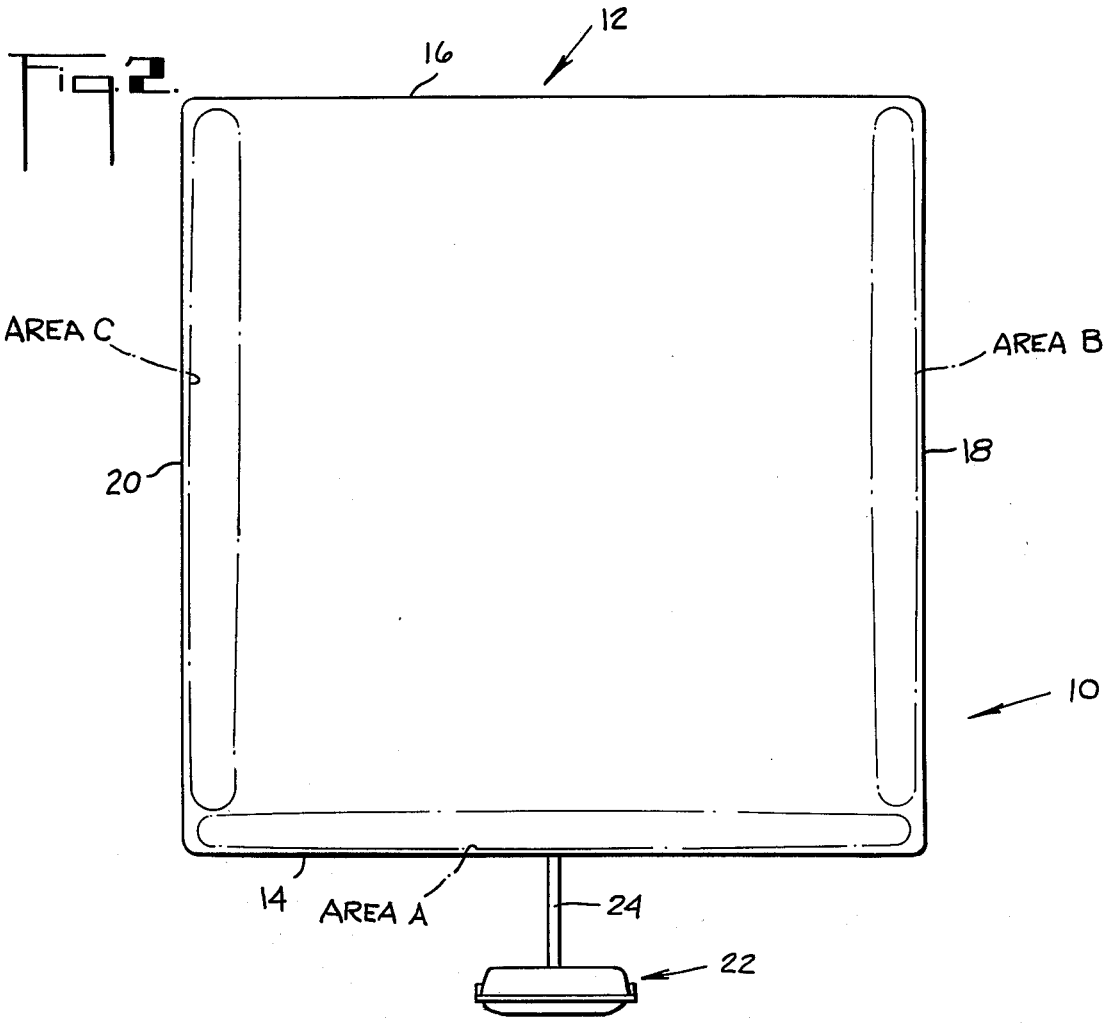
FIG. 2 is a front elevational view of the arrangement illustrated in FIG. 1.

Turning now to the drawings, wherein like components are designated by like reference numerals throughout the various figures, a sign lighting arrangement is illustrated in FIGS. 1 and 2 and generally designated by the reference numeral 10. As shown, arrangement 10 includes a rectangular sign 12 having a bottom edge 14, a top edge 16 and opposite side or lateral edges 18 and 20. The sign is held in place, preferably in a vertical plane, by conventional means not shown.

Arrangement 10 also includes a luminaire 22 which, in the embodiment illustrated in FIGS. 1 and 2, is positioned in front of the sign, slightly below lower edge 14 and centrally between side edges 18 and 20. The luminaire may be supported in this position in any suitable manner. For example, as illustrated in FIG. 1, a conduit 24 extends from the luminaire to the sign and turns up and against the back side of the latter where it is held in place against the sign by conventional means such as clamps 26. Where a ballast is necessary for use with luminaire 22, one can be conveniently located on the back side of the sign and operatively connected with the luminaire through conduit 24, the ballast being generally indicated by the reference numeral 28 in FIG. 1. In this regard, while the various electrical components required in operating luminaire 22 are not shown, they would, of course, be provided and conveniently located.

While luminaire 22 is provided for lighting up the entire front surface of sign 12, the present invention in one aspect is particularly concerned with illuminating the entire bottom edge portion of the sign and in another aspect it is particularly concerned with illuminating the entire side edge portions of the sign. These edge portions are indicated in FIG. 2 as Area A, Area B and Area C. As will be seen hereinafter, the luminaire is specifically designed to light up these areas without directing light either below the bottom edge of the sign or outside and past the side or lateral edges, i.e., positive bottom and side edge cut-off.

Turning to FIGS. 3–5, luminaire 22 is shown apart from arrangement 10. The luminaire includes an opaque support 30 which is comprised of a front or forward most section 32, opposite side sections 34, a back section 36 and a base or bottom 38. As illustrated best in FIGS. 3 to 5, the side sections 34 extend rearwardly from opposite ends of the front section 32 and terminate at opposite ends of back section 36. Bottom or base 38 extends from the bottom edge of front section 32 rearwardly along the bottom edges of side sections 34 and merges with back section 36.

As illustrated, front section 32, side sections 34 and back section 36 respectively include flanged top edges 40, 42 and 44. In accordance with the present invention, all of the top edges 40 and 42 are flat and lie in a common plane, as best seen in FIG. 3. This is to provide positive bottom edge cut-off as will be discussed hereinafter. For purposes of convenience, top edge 44 is also flat and also lies in the common plane with edges 40 and 42.

Luminaire support 30 may be constructed of any suitable material but is preferably integrally formed of cast aluminum. In addition, as noted best in FIG. 4, the top edges 42 of the support in this embodiment taper outwardly from front section 40 so that in a plan view the support is somewhat trapazoidal in configuration. Further, as shown best in FIG. 3, these same top edges 42 taper downwardly from the top edge of the front section 32 before terminating with the top edge of back section 36. The reasons for both of these particular configurations will be discussed hereinafter.

In addition to support 30, luminaire 22 includes a conventional socket 46 for supporting a light source 48. While any suitable light source generally provided in the sign lighting art may be used (either point or line source), it is preferably either mercury, metal halide, or high pressure sodium. Socket 46 is held by suitable means (not shown) against one of the side walls 34 and is strategically positioned so that the center of light source 48 (whether the light source is a point or line source) lies approximately centrally between the side sections 34 and in the aforestated common plane with top edges 40 and 42. This is best indicated in FIGS. 3 and 4.

Luminaire 22 also includes a reflector 50 which will be discussed in detail hereinafter and a refractor 52 which has been omitted from some of the figures for purposes of clarity but which will be discussed in detail with respect to FIGS. 9 and 10. In this regard, the refractor is provided for conventional purposes and also to aid in providing positive side edge cut-off. The way in which this light is refracted will be discussed hereinafter but, in any case, does not appreciably change the direction of the reflected or direct light, as will be seen.

Turning to FIGS. 7, 7A and 8 in conjunction with FIGS. 3 and 4, attention is directed to reflector 50. This reflector, which is constructed of any suitable material such as polished aluminum, is curvilinear (partially parabolic) in cross-section and relatively straight in lateral section. The reflector has an outer periphery defined by a forward lower edge 54, a rearward top edge 56 and side or lateral edges 58. For operational purposes, only the inside face 60 of the reflector need be made of a reflective material since only this surface will be used for reflecting light. In addition, for an operational description, reflective surface 60 may be separated into two segments, a lower segment 60A bounded by edge 54, side edges 58 and an imaginary line 62 running laterally across the reflector and an upper segment 60B bounded by the same imaginary line, side edges 58 and edge 56. As will be seen hereinafter, the bottom segment 60A, which is preferably parabolic in cross-section, is responsible for directing reflected light onto an upper portion of sign 12 and upper segment 60B, which is preferably generally curvilinear in cross-section, is responsible for directing reflected light onto the lower portion of the sign.

While it was stated that reflector 50 is substantially straight in lateral section, it should be noted that this is not necessarily the case in an area near and at the top edge 56. At these points, as seen best in FIGS. 7 and 7A, the reflector preferably includes scalloped sections 64 which together provide forwardly successive positioned steps as they progress from the center of the reflector to the lateral edges and which angularly widen the distribution of reflected light from these areas. In this manner, the lower corners of sign 12 can be further illuminated, as will be seen.

As illustrated best in FIG. 7, side or lateral edges 58 of reflector 50 are contoured outwardly from front edge 54 to back edge 56. The manner and reason for these specific contours will be discussed hereinafter. For the moment, it should suffice to say that edges 58 are contoured to provide positive side edge cut-off, that is, for illuminating areas B and C of sign 12 with reflected light without allowing reflected light of any significant amount to pass beyond the side edges 18 and 20 of the sign.

Reflector 50 is connected by conventional means (not shown) with support housing 30 such that the top edge 56 lies behind and slightly above light source 48. From this point the reflective surface extends around the back and under the light source such that lower edge 54 is located forwardly of the latter and just rearwardly of front section 32. In addition, contoured side edges 58 of the reflector are positioned adjacent to and run approximately parallel with the side section 34 support 30, thus accounting for the somewhat trapazoidal shape of the support. Note that the side sections taper inwardly (see FIG. 5). In this regard, the side sections 34 and lateral edges 58 are positioned relative to one another and relative to the light source such that substantially none of the light reflected from the reflector's lateral edges is blocked by side sections 34.

Luminaire 22 has been described as having a support or housing 30, a light source supporting socket 46, a light source 48, a reflector 50 and a refractor 52. For purposes of the present invention, these are the features of most import. The luminaire does however include various other conventional components which have not been illustrated. For example, there are conventional means for supporting the reflector and the refractor in the positions illustrated in the drawings. The electrical circuitry required for use with the luminaire is also conventional. These and other conventional features which have not been illustrated would be obvious to those skilled in the art.

Having described the construction of luminaire 22, attention is now directed to the manner in which it operates to provide positive cutoff along the lower edge and side edges of the sign 12. In this regard, FIG. 6 illustrates the luminaire in an operating position, that is, in a position that would be maintained for illuminating sign 12. As noted, the top flat edges of support 30 and particularly edges 40 and 42 and light source 48 (actually the center of the light source) lie in a common plane, generally designated Plane I. For reasons to become apparent hereinafter, Plane I preferably extends at an acute angle with the horizontal. In addition to this Plane, a second plane, generally designated Plane II, is shown in FIG. 6 normal to Plane I and also passing through light source 48 such that the light source lies along or on the intersection between Planes I and II. Together, the two planes divide the area around the luminaire and particularly around the light source into four quadrants generally designated Area I, Area II, Area III and Area IV. Operation of the luminaire will first be discussed with respect to these areas and thereafter with respect to sign 12.

It should be apparent from FIG. 6, that direct light from source 48 will be directed towards all four Areas I–IV. However, it should be equally apparent that the side sections 34, front section 32 and bottom 38 of support 30 will prevent direct light from passing into that portion of Area II outside the luminaire. However, direct light is allowed to pass into Area I over the top edges 40 and 42 of support 30. This, as will be seen, provides the basis for positive cutoff of direct light along the lower edge of sign 12. Since the side sections 34 and bottom or base 38 extend rearwardly beyond the light source, direct light is also prevented from passing into that portion of Area IV outside the luminaire.

This leaves only Areas I and III. In this regard, as will be discussed below, reflector 50 is positioned so as to intercept most of the light directed into Area III and redirect the same back into Area I. In fact, the reflector will also intercept most of the light which is otherwise directd towards Area II and IV for redirecting the same back into Area I, the area in which the sign is to be located. There are, however, slight exceptions to this. There will be some direct light which emanates laterally, that is, along Plane II or approximately laterally from the light source into Area III without being intercepted by either the support 30 or reflector 50. Direct light will also emanate directly up Plane II and possibly into Area III. However, most of this light as well as the direct light which emanates approximately laterally from the light source into Area I is either diffused by the refractor or is bent inwardly so as to be usable for illuminating the sign. This will be discussed hereinafter.

As stated above, the reflector 50 is positioned over, around, under and in front of the light source for intercepting direct light entering into Areas II, III and IV and redirecting the same back into Area I. As also stated above, the reflector is separated into two segments, segments 60A and segment 60B as shown in FIG. 7. Segment 60B is responsible for reflecting light from the source onto the lower segment of sign 12, that is, the light reflected from segment 60B is directed into Area I near Plane I. In this regard, the reflector is preferably positioned such that none of the reflected light from segment 60B passes over the front edge 40 of support 30 and into Area II such that it could possibly pass under the sign. Segment 60A of the reflector is responsible for directing light into Area I at a greater angle with Plane I than the light reflected from segment 60B. In this manner, the reflected light from segment 60A is provided to illuminate the upper portion of sign 12.

As also stated above, the side or lateral edges 58 of reflector 50 are specifically contoured to provide positive cutoff along the lateral edges of sign 12. As best illustrated in FIG. 4, these edges are located on opposite sides of source 48, that is, laterally of the source. Since the reflector is straight in lateral section, these edges determine the lateral boundaries of light reflected onto a given plane into Area I. The contour of these edges will determine the exact contour of the lateral edges of reflected light on the given plane in Area I. Hence, to appropriately contour edges 58 to provide straight line boundaries of reflected light, a predetermined distance apart in a particular plane, the plane must be chosen along with the distances between these straight line boundaries, the distances and angles between these boundaries and the reflector and the relative position of the reflector and light source. In other words, the geometry resulting from the relative location of the luminaire, particular plane and desired straight line boundaries of reflected light must be determined. For purposes of the present invention, the vertical plane is chosen as the plane in which the sign 12 lies and the straight line boundaries of the reflected light in this plane are chosen to coincide with the side edges of the sign, thereby providing positive side edge cutoff. In addition, the luminaire 22 is placed in its ultimate fixed position relative to the sign for determining the required geometry.

To illustrate the foregoing, attention is directed to FIG. 11 which shows a front elevational view of sign 12. Also shown in this figure are dotted lines 69 which extend from the bottom corners of the sign upward and outward from side edges 18 and 20 at acute angles with the edges. These dotted lines represent the lateralmost edges of reflected light onto the plane of the sign from a luminaire 22 properly positioned in front of the sign (not shown). However, the reflector responsible for edges 69 has not been contoured for positive side edge cut-off but rather includes lateral edge portions extending laterally greater distances from the light source than the contoured lateral edges of the present invention.

In accordance with the present invention, portions of these uncontoured lateral edge portions are eliminated such that the reflected light between dotted lines 69 and side edges 18 and 20 is eliminated. In this manner, the lateral edges of reflector 50 are now contoured such that the lateralmost vertical edges of reflected light onto the plane of the sign substantially coincide with the side edges 18 and 20 of sign. In this regard, it is to be understood that the exact contour of lateralmost edges 69 of reflected light from an uncontoured reflector will depend on the specific contour of the uncontoured reflector and are not limited to that shown.

Once the particular plane in Area I is chosen along with the points of lateral cutoff, there are different ways in providing the contour of edges 58. In any event, once the sign and luminaire are positioned in place, one with skill in the art, in view of the present disclosure, could determine the contour of the reflector's lateral edges so that the lateralmost edges of reflected light in the plane of the sign coincide with the entire vertical lateral edges of the sign. At this point, it should be noted that the specific configuration of side sections 34 of support 30 is not determined until after determining the lateral edge contour of the reflector. In this manner, the side sections can be readily contoured so that they do not block substantially any of the light reflected by the lateral edge portions of the reflector. Rather, the reflected light from these points goes over the top edges of the side sections.

Turning to FIGS. 9 and 10 attention is directed to refractor 52. As illustrated, the refractor sits directly on the flanged top edges 40, 42 and 44 of housing 30 and comprises a top wall 70, opposite side walls 72 and a back wall 74. The top wall curves up from the top edge 40 of housing 30 and eventually back down to merge with back wall 74 (FIG. 3). Hence, the side walls 70, which are defined by the top edges 42 of the housing, top wall 70 and back wall 74, are somewhat triangular in shape.

For purposes of description, refractor 52 is divided into two symmetrical sections **52*A* and 52*b* by a centerline indicated in FIG. 10. Each section may be divided into five functional segments, namely, segments A, B, C, $D_1$ and $D_2$. The function of each segment will be discussed below. In this regard, corresponding segments of the sections 52*a* and 52*b*** operate in a similar manner.

With the refractor, reflector and housing assembled together, segments A of the refractor are opposite the parabolic segment 60A of the reflector. These segments permit reflected light to be directed virtually unaltered to the top areas of the sign. These segments do, however, have a significant effect on the direct light. Each contains a system of prismatic flutes (not shown) which diffuse the direct light laterally and an additional system of random prismatic stipples which provide both vertical and lateral diffusion to the direct light, smoothing out the direct light falling on the sign, particularly in the lower areas of the sign. In this regard, the flutes and stipples do, in fact, act on the reflected light but since this light is substantially more concentrated than the direct light the prismatic effects of the flutes and stipples on the reflected light are insignificant and may be ignored.

Segments B are located directly above segments A and are provided for sending direct light from source 48 to the lateral edges of the sign over the entire vertical length of the sign. This is accomplished by utilizing suitably positioned and contoured prisms on segments B.

Segments C, which are positioned directly above segments B, handle the reflected light from the top portion of the reflector, mostly from the scallops 64 of the reflector and send it also to the lateral edges of the sign over the entire vertical length of the sign. This, also is accomplished by providing suitably positioned and contoured prisms on segments C.

The sidewalls 72 of the refractor are clear-cut in their operation and structure. They deal with direct light only and again send it to the lateral edges of the sign over the sign's entire vertical height. Sections $D_1$ contain prismatic flutes and prisms on the inside only which diffuse and control the light toward the lower ends of the sign's lateral edges. Sections $D_2$ contain prisms on the inside of the refractor and on the outside sending the direct light to the upper portions of the lateral edges of the sign. All prisms in Section $D_1$ and $D_2$ are parallel to each other. The area on the sidewalls behind segment D and the area on the top wall behind segment C do not contribute to the illumination of the sign. In this regard, it should be noted that substantially none of the reflected light is directed towards and through the side walls of the refractor but is rather directed towards and through the top wall thereof.

Having described the operation of luminaire 22, attention is now directed to the specific manner in which it operates in arrangement 10. In this regard, attention is redirected to FIGS. 1 and 2. As shown in these figures, the luminaire is positioned in front of the sign, approximately centrally between lateral edges 18 and 20 and slightly below bottom edge 14. In addition, the top edges 40 and 42 of the support 30 and the light source 48, all of which reside in plane I, (FIG. 6) are aligned with the bottom edge 14 of the sign so that the latter also lies in Plane I. In this manner, direct light passes over the top edges but none of the direct light from the source can pass under the sign. In addition, as stated above, the reflector is positioned such that none of the reflected light passes under the sign. Hence, positive lower edge cut-off is achieved while at the same time Area A extending along the entire lower edge portion of the sign (FIG. 2) is illuminated. In this regard, the aforedescribed scalloped sections 64 of the reflector in conjunction with Segments C of the refractor aid in lighting the lower corners of the sign.

As stated above, the lateral edges of the reflector 50 are contoured to provide lateralmost straight line boundaries in a specific plane from light reflected from these edges. This reference plane is chosen to be that in which the sign 12 lies and the lateral boundaries of the reflected light directed into that plane are chosen to substantially coincide with Areas B and C shown in FIG. 2, that is, the lateral edge portions of the sign. Hence, while reflector 50 of luminaire 22 is capable of lighting substantially the entire lateral edge portions of the sign (Areas B and C), it also provides positive cutoff beyond these points, i.e., substantially no reflected light will pass beyond the lateral edges of the sign. It should also be noted that the direct light (actually refracted light) which would otherwise pass beyond Areas B and C, is preferably either diffused or refracted inwardly by Segments D of the refractor so as to aid in illuminating the sign along the lateral edges. A small amount of direct light may escape past the edges 18 and 20 of the sign but is, for the most part, insignificant.

While the foregoing descriptions have been directed to the illumination of Areas A, B and C of sign 12, it should be apparent that luminaire 22 is provided for lighting up the entire front face of the sign.

Having described arrangement 10 including the construction and operation of luminaire 22, attention is now directed to an actual working embodiment. In the embodiment, a sign 10 feet wide and 10 feet high (a typical highway information sign) is located in a vertical plane. A luminaire constructed in accordance with the present invention is positioned in front of the sign in the manner illustrated in FIGS. 1 and 2. The luminaire, which is slightly less than 2 feet wide at its lateralmost points, is positioned 4 feet in front of the sign and one foot below the bottom edge. Hence, the aforedescribed common plane lies at approximately a 14° angle with the horizontal. This accounts for the downward tapering of the luminaire support's top edges. With this geometry, the lateral edges 58 of the reflector 50 were contoured in the manner shown in FIG. 7 to provide positive side edge cut-off. In this regard, should the relative distances between the luminaire and the sign be substantially changed, edges 58 and support 30 would necessarily be recontoured to compensate for the change in geometry.

The above-described working embodiment has been provided for illustrative purposes only and is not intended to limit the present invention.

What is claimed is:

1. A lighting arrangement comprising:

a. a rectangular sign located in a fixed position and including a top edge portion, a bottom edge portion and opposite side edge portions; and b. a luminaire including i. a light opaque luminaire support comprising a front section having a flat top edge, and side sections located at opposite ends of said front section and extending rearwardly therefrom, each of said side sections including a flat top edge which extends from an associated end of said front section and wherein all of said flat top edges lie in a common plane, said front and side sections extending from said plane into a first area to one side of said plane.

ii. a light source disposed between the said side sections and rearwardly of said front section and in said common plane, iii. a reflector having a reflective surface, said surface being positioned between said side sections and extending from above said source around the back side of said source and under and forward thereof, said surface including a top rear section located behind and above said source for directing light from said source towards a specific one of said edge portions and a bottom front section located in front of said source for directing light from said source towards a segment of said sign including an opposite edge portion thereof, said segment being to one side of said specific edge portion, and iv. means for supporting said light source and reflector with said support;

c. means for locating said luminaire in a predetermined position in front of said sign such that i. said specific one edge portion of said sign lies in said common plane with the remainder of said sign being located in a second area on the opposite side of said plane as said first area, and ii. said front and side sections of said opaque luminaire support prevent specific direct light from said source from escaping said luminaire, said specific light being direct light which would otherwise pass into said first area and beyond said one edge portion of said sign.

2. A lighting arrangement according to claim 1 wherein said sign lies in a vertical plane and said common plane extends at an acute angle with respect to a horizontal plane.

3. A light arrangement according to claim 1 wherein said reflector includes lateral edge portions, the entire portions of which are contoured to reflect the light intercepted thereby to coincide with substantially the entire side edge portions of said sign and wherein said arrangement further includes a refractor positioned over and against the top edges of said front and side sections.

4. A lighting arrangement according to claim 3 wherein said predetermined position of said luminaire is such that said luminaire is located in closer proximity to said top edge portion of said sign than said bottom edge portion.

5. A lighting arrangement according to claim 3 wherein said predetermined position of said luminaire is such that said luminaire is located in closer proximity to said bottom edge portion of said sign than said top edge portion.

6. A lighting arrangement according to claim 5 wherein the predetermined position of said luminaire is such that said luminaire is located in front of said sign, slightly below said bottom edge portion and substantially centrally between said side portions.

7. A lighting arrangement according to claim 5 including a refractor positioned over and against the top edges of said front and side sections of said support and including a. a top wall tapering upwardly and rearwardly of the top edge of said front section and having i. a first segment for allowing light reflected from a bottom section of said reflective surface to pass substantially unaltered to top areas of said sign, ii. a second segment adjacent to said first segment and including prismatic means for aiding in directing some of the light from said source towards the side edges of said sign, and iii. a third segment adjacent said second section and including prismatic means for aiding in directing some of the light reflected from a top section of said reflective surface towards the side edges of the sign, and b. opposite side walls extending upwardly from the top edges of said side sections of said support, each side wall having a segment including prismatic means for directing some of the light from said source onto an adjacent side edge of said sign.

8. A lighting arrangement according to claim 3 wherein said luminaire is positioned closer to one of said top or bottom edge portions of said sign than the other of said top or bottom edge portion and wherein said reflected light from said contoured edge portions of said reflector define the lateral most reflected light from said luminaire.

9. A lighting arrangement according to claim 3 wherein said reflector includes a top edge and a bottom edge connecting said lateral edge portions, said top and bottom edges and lateral edge portions defining the outer periphery of said reflective surface being substantially straight in lateral section and curving in a concave fashion from said bottom edge to said top edge.

10. A lighting arrangement according to claim 1 wherein said one edge portion of said sign is said top edge portion.

11. A lighting arrangement according to claim 1 wherein said one edge portion of said sign is said bottom edge portion.

12. A lighting arrangement comprising:

a. a rectangular sign located in a fixed position and including a top edge portion, a bottom edge portion and opposite side edge portions; and b. a luminaire located in a predetermined position in front of said sign for directing light onto said sign, said luminaire being located closer to one of said top or bottom edge portions than the other of said top or bottom edge portions, said luminaire including a light source, a reflector having a reflective surface and means for supporting said light source and reflector in a fixed position relative to one another such that, said reflective surface extends from above said light source around the back side of said source and under and forwardly thereof, said surface including a top rear section located behind and above said source for directing light from said source towards said closer one of said edge portions and a bottom front section located in front of said source for directing light form said source toward a segment of said sign including the opposite edge portion thereof, to one side of said closer edge portion, said reflective surface intercepting and redirecting light from said source onto said sign and including lateral edge portions, the entire edge portions of which are contoured to reflect the light intercepted thereby to coincide with substantially the entire side edge portions of said sign, said reflected light from said contoured edge portions of said reflector defining the lateral most reflected light from said luminaire.

13. A lighting arrangement according to claim 12 wherein said closer one edge portion of said sign is said top edge portion.

14. A lighting arrangement comprising:

a. a rectangular sign located in a fixed position and including a top edge portion, a bottom edge portion and opposite side edge portions;

b. a luminaire located in a predetermined position in front of said sign for directing light onto said sign, said luminaire being located closer to said bottom edge portion than said top edge portion, said luminaire including a light source, a reflector having a reflective surface and means for supporting said light source and reflector in a fixed position relative to one another, said reflective surface intercepting and redirecting light from said source onto said sign and including lateral edge portions, the entire edge portions of which are contoured to reflect the light intercepted thereby to coincide with substantially the entire side edge portions of said sign, said reflected light from said contoured edge portions of said reflector defining the lateral most reflected light from said luminaire, said reflective surface further including a top edge portion including a plurality of scalloped sections, said scalloped sections intercepting light from said light source and redirecting said intercepted light onto the bottom portion of said sign near the side edge portions of the sign; and c. a refractor disposed over said light source and reflector, said refractor including prismatic segments refracting the light intercepted and redirected by said scalloped sections of said reflector for aiding in directing said last-mentioned light onto the bottom portion of said sign near the side edge portions of the sign.

* * * * *